US006431888B1

(12) United States Patent
Crestin

(10) Patent No.: US 6,431,888 B1
(45) Date of Patent: Aug. 13, 2002

(54) ELECTRIC OUTLET SOCKET PROVIDED WITH A SEALED BELLOWS JOINT

(75) Inventor: Joseph Crestin, Vanves (FR)

(73) Assignee: Societe d' Exploitation des Procedes Marechal (SEPM), societe anonyme, Saint-Maurice, Cedex (FR)

( * ) Notice: Subject to any disclaimer, the term of this patent is extended or adjusted under 35 U.S.C. 154(b) by 0 days.

(21) Appl. No.: 09/714,525

(22) Filed: Nov. 17, 2000

(30) Foreign Application Priority Data

Nov. 19, 1999 (FR) ..... 99 14554

(51) Int. Cl.[7] ..... H01R 13/52
(52) U.S. Cl. ..... 439/141
(58) Field of Search ..... 439/139, 140, 439/141, 142

(56) References Cited

U.S. PATENT DOCUMENTS 3,683,315 A * 8/1972 Kelly ..... 439/141
3,982,804 A 9/1976 Marechal ..... 439/139
4,810,199 A * 3/1989 Kar ..... 439/141
5,584,712 A 12/1996 Fukushima
5,722,856 A * 3/1998 Fuchs et al. ..... 439/578

FOREIGN PATENT DOCUMENTS

FR 2270696 12/1975
FR 2701604 8/1994

* cited by examiner

*Primary Examiner*—Renee Luebke
(74) *Attorney, Agent, or Firm*—Greenblum & Bernstein, P.L.C.

(57) ABSTRACT

A first electrical connector including a casing. An insulating support is disposed within the casing. A plurality of first electrical contacts are mounted in the insulating support. A bellows joint is disposed between the insulating support and the casing. At least one elastic mechanism is adapted to bias the bellows joint towards an extended position. The first electrical connector is adapted to connect to a second electrical connector having a plurality of second electrical contacts which engage the plurality of first electrical contacts. The bellows joint is adapted to move to a retracted position when the second electrical connector is connected to the first electrical connector.

21 Claims, 4 Drawing Sheets

ELECTRIC OUTLET SOCKET PROVIDED WITH A SEALED BELLOWS JOINT

CROSS-REFERENCE TO RELATED APPLICATIONS

The instant application is based upon French priority Patent Application No. 99 14554, filed Nov. 19, 1999, the disclosure of which is hereby incorporated by reference thereto in its entirety, and the priority of which is hereby claimed under 35 U.S.C. § 119;

BACKGROUND OF THE INVENTION

Field of the Invention

The present invention relates to an electric outlet socket provided with a sealed bellows joint, the outlet being fixed or mobile to link up to a connector.

DESCRIPTION OF BACKGROUND AND RELEVANT INFORMATION

The word connector is used here for simplification whereas according to standardised terms it concerns a connector socket.

The connector can also be fixed or provided with a handle to form a plug.

Such an electric outlet socket is provided with a cover and electrical contacts which are mounted in an insulating support set in a casing and which are intended to link up with opposite contacts of a connector also provided with a casing intended to be introduced between the insulating support and the socket casing during the linkup between the connector and the socket.

A device of this kind is described in particular in the French patent 2 270 696.

One of the problems to be solved for this type of connection device in certain utilisation conditions, concerns the seal of the socket in the state when the cover is closed, as well as the seal between the socket and the connector, the latter being linked, in rest position that is to say non-connected, or in connected position.

SUMMARY OF THE INVENTION

This is the reason why the invention relates to an outlet socket which is specially notable in that a bellows joint is set in a sealed manner around the insulating support of the socket, between the insulating support and the socket casing while at least one elastic Mechanism is envisaged to pull the joint towards an extended position, the joint taking up a retracted position when it is pulled by the front end of the casing of the connector against the effect of the elastic Mechanism.

An electric outlet socket, particularly like the one described in the above-mentioned patent 2 270 696, is generally provided in addition with an ejection washer which is set between the insulating support and the casing of the socket and which is intended to be pulled by the front end of the casing of the connector during the linkup between the connector and the socket against the effect of at least one elastic Mechanism with which the washer is provided.

In this advantageous embodiment of the invention, the bellows joint covers at least partly the top of the ejection washer in such a way that this covering part of the joint is inserted between the washer and the front end of the casing of the connector in the position where the connector is linked in the socket, the elastic Mechanism of the ejection washer thus serving as elastic Mechanism for the extension of the joint.

Preferably, the cover of the socket is provided with an annular skirt intended to be introduced into the casing of the socket when the socket is not linked with the connector, the height of the skirt being chosen so that in a closed position its front end applies pressure to the part of the joint which covers the ejection washer.

In this latter case, with a socket provided as well with at least one safety disc locked in angular position at rest by at least one lip provided on the ejection washer, the unlocking being carried out by the connector during the linkup, the height of the skirt of the cover is chosen to apply pressure and push back the ejection washer without the latter going beyond its unlocking position of the safety disc.

In this way, the joint according to the invention ensures the seal of the socket, whether this is closed by its cover, or linked with a connector in a rest position or in a connection position.

The invention provides for a first electrical connector comprising a casing, an insulating support disposed within the casing, a plurality of electrical contacts mounted in the insulating support, a bellows joint disposed between the insulating support and the casing, and at least one elastic mechanism adapted to bias the bellows joint towards an extended position, wherein the first electrical connector is adapted to connect to a second electrical connector having a plurality of second electrical contacts which engage the plurality of first electrical contacts, and wherein the bellows joint is adapted to move to a retracted position when the second electrical connector is connected to the first electrical connector.

The first connector may further comprise a cover for protecting the electrical connector. The first electrical connector may be a socket connector and the second electrical connector may be a plug connector. The plurality of first electrical contacts of the first electrical connector may be socket type contacts and the plurality of second electrical contacts of the second electrical connector may be pin type contacts. The bellows joint may be set in a sealed manner around the insulating support. The second electrical connector may comprise a casing and the casing of the second electrical connector may be adapted to move the bellows joint to the retracted position against a biasing force of the at least one elastic mechanism.

The first connector may further comprise an ejection washer disposed between the insulating support and the casing. The second electrical connector may comprise a casing and the casing of the second electrical connector may be adapted to engage the ejection washer and move the bellows joint to the retracted position against a biasing force of the at least one elastic mechanism. The ejection washer may comprise an upper surface which engages a shoulder of the bellows joint. The casing of the second electrical connector may be adapted to move within the shoulder of the bellows joint. The ejection washer may comprise a lower surface which engages the elastic mechanism.

The first connector may further comprise a cover for protecting the first electrical connector, the cover including a skirt which is adapted to engage the ejection washer. The skirt may comprise a length sufficient to move the bellows joint from the extended position when the cover is in a covering position.

The first connector may further comprise an ejection washer and at least one safety disc. The safety disc may be adapted to be locked in an angular position. The safety disc may comprise a lip for locking the safety disc in an angular position. The safety disc may be disposed adjacent the ejection washer. The second electrical connector may comprise a casing and the casing of the second electrical connector may be adapted to engage the ejection washer and move the bellows joint to the retracted position against a biasing force of the at least one elastic mechanism, and the safety disc may be adapted to be unlocked when the casing of the second electrical connector engages the ejection washer.

The invention also provides for an electrical connector comprising a cylindrical casing, a circular insulating support disposed within the casing, a plurality of first electrical contacts mounted in the insulating support, a movable biasing mechanism disposed between the insulating support and the casing, the biasing mechanism having at least an extended position and a retracted position, wherein the electrical socket connector is adapted to connect to another connector having a plurality of second electrical contacts which engage the plurality of first electrical contacts.

The invention also provides an electrical connector comprising a cylindrical casing, a cover pivotally mounted to the casing, a circular insulating support disposed within the casing, a plurality of first electrical contacts mounted in the insulating support, a safety disc rotatably mounted to the insulating support, an ejection washer engaging a movable biasing mechanism, the movable biasing mechanism being disposed between the insulating support and the casing, the biasing mechanism having at least an extended position and a retracted position, wherein the electrical socket connector is adapted to connect to another connector having a plurality of second electrical contacts which engage the plurality of first electrical contacts.

BRIEF DESCRIPTION OF THE DRAWINGS

The invention will be well understood by reading the following description, which refers to the drawings in the appendix in which.

DETAILED DESCRIPTION OF THE INVENTION

The embodiment represented concerns an electric outlet socket 1 provided here with an inclined sleeve 1'.

The method of representation was chosen for reasons of clarity and understanding, but the sleeve 1' is generally set on a vertical wall such as the wall of an electric box, while the socket 1 is directed lower.

In addition, as mentioned above, it can involve a mobile electric outlet, in which case the sleeve 1' is to be replaced by a handle.

The socket 1 represented comprises contacts in the usual way, here by pressure from the end such as the central contact 2 provided with a spring.

This central contact is in general an earth contact whereas evidently the phase contacts are set around the edge.

The contacts are mounted on an insulating support 3 set in a casing 4.

Figure 2:
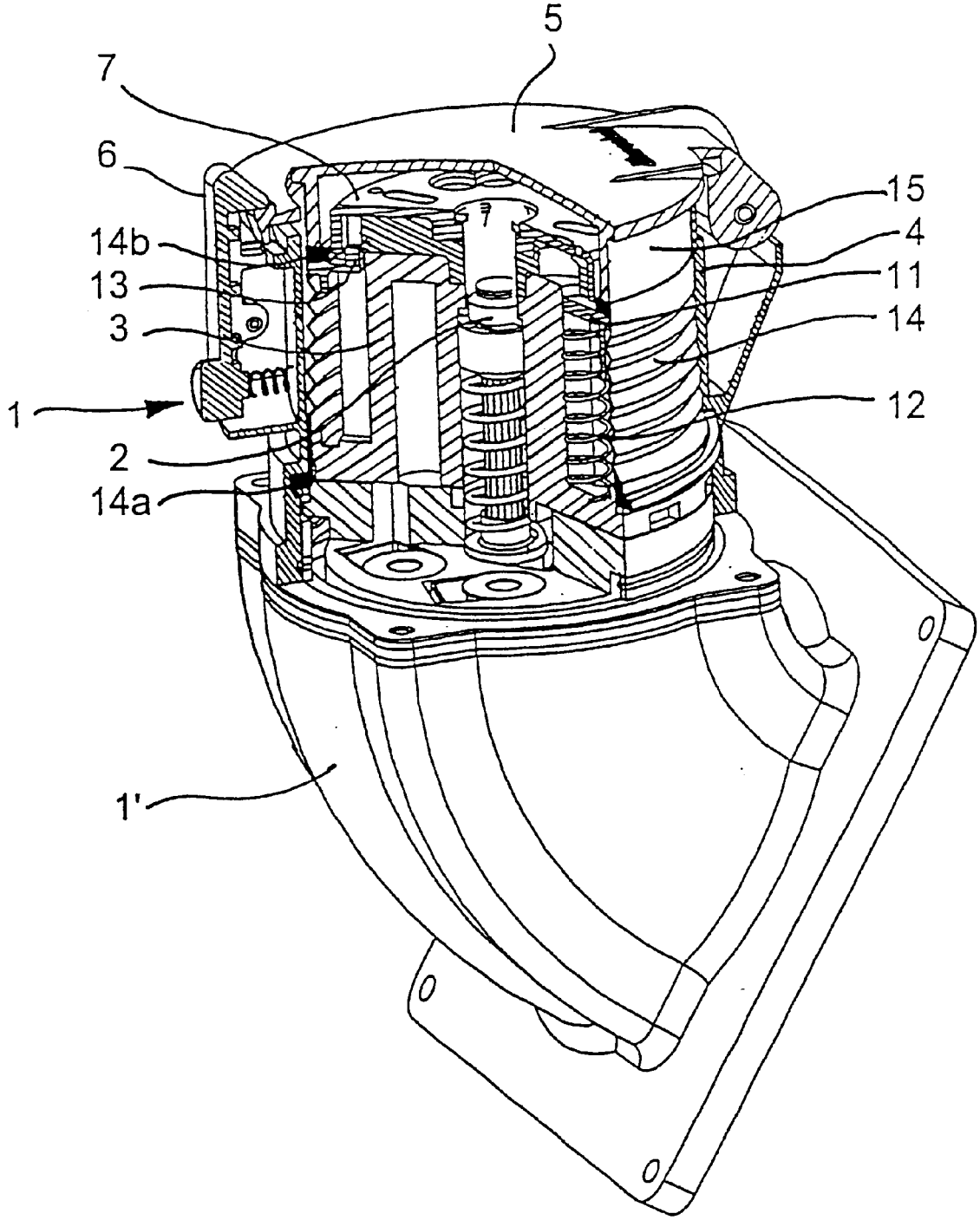
FIG. 2 shows in perspective and partial cross sections the socket of FIG. 1 with its cover in the closed position.

The casing 4 is provided with a cover 5 mounted to pivot, and which is intended to come down to close the casing 4, as shown in FIG. 2, being locked in this position by way of a hook 6.

Figure 3:
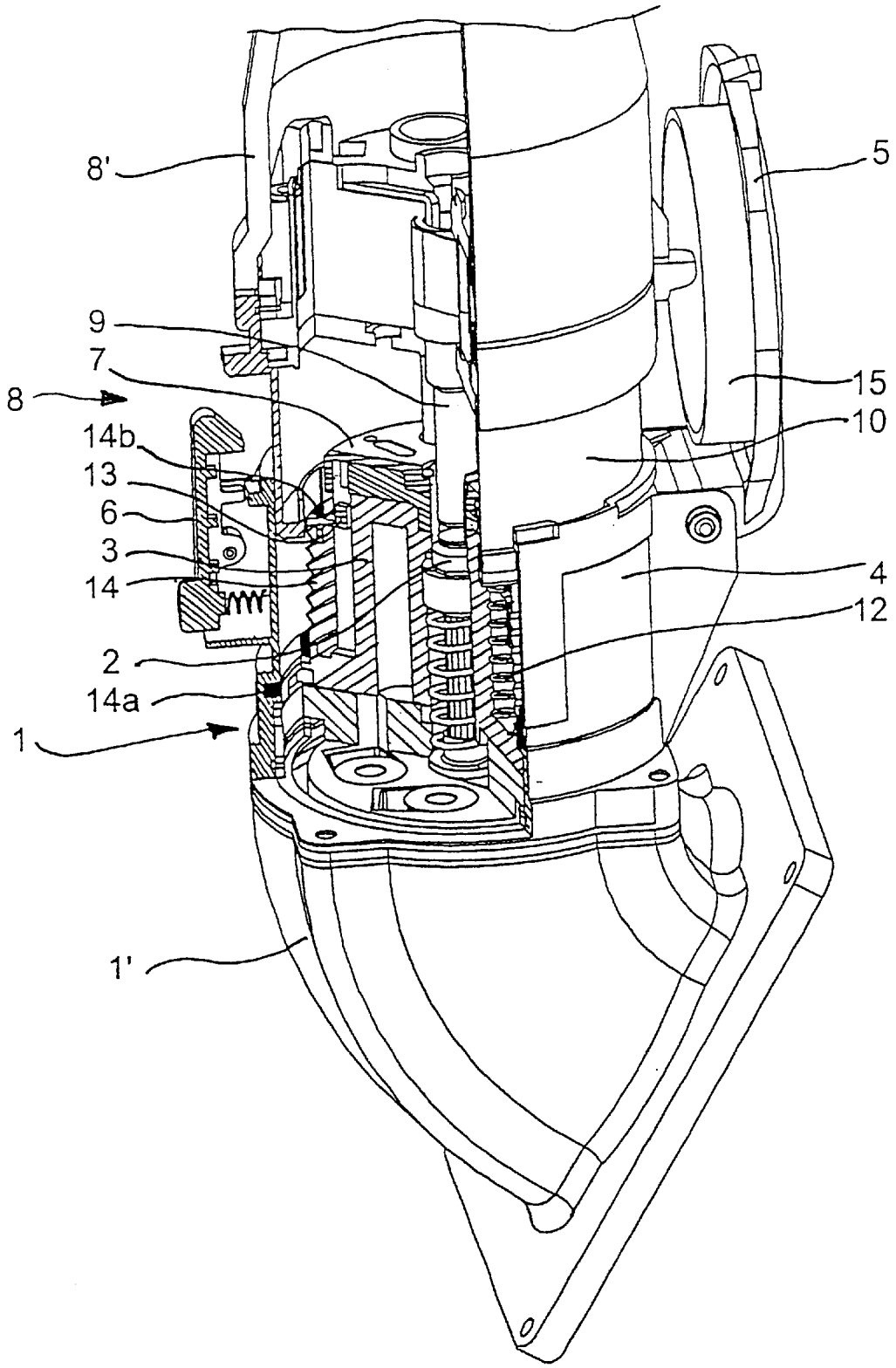
FIGS. 3 and 4 show in perspective and partial cross sections the socket of FIGS. 1 and 2 with a connector in rest and linkup positions respectively.
Figure 4:
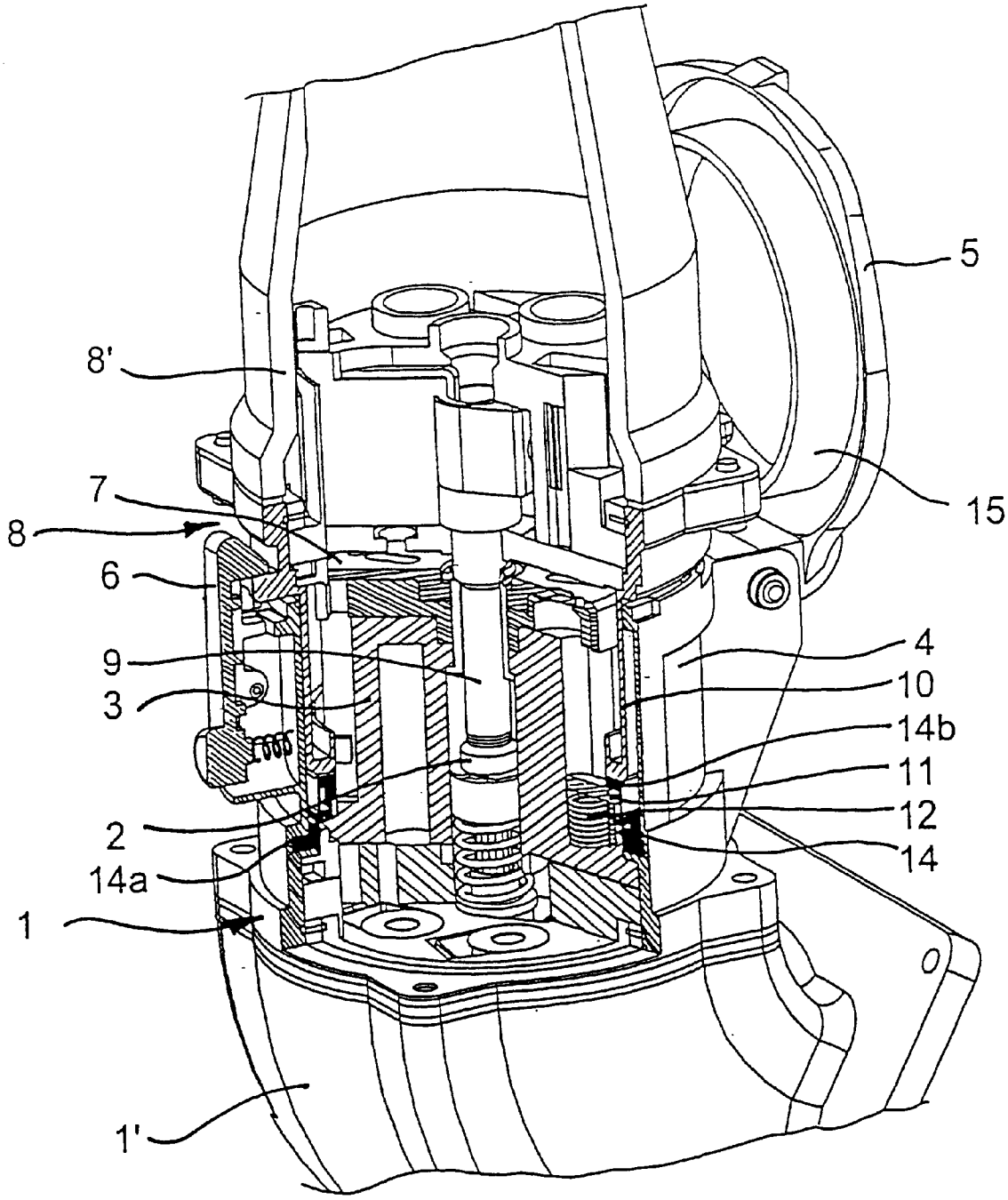

The contacts of the socket 1 are intended to link up with the opposite contacts of a connector 8 (FIGS. 3 and 4), the contacts of the connector being for example in the form of fixed pins, such as the central contact 9 (FIGS. 3 and 4).

The connector 8 is provided with a handle 8' and together with it forms a plug.

The connector 8 is also provided with a casing 10 which is intended to be introduced between the insulating support 3 and the casing 4 of the socket during the linkup between the connector; and the socket.

The contacts of the socket 1 possibly with the exception of the central contact 2, are protected and hidden when at rest by a rotating safety disc 7 provided with at least the same number of openings as the connector 8 and generally the socket 1 are provided with contacts.

In addition, the socket 1 is provided, in the embodiment shown, with an ejection washer 11 pulled by at least one spring 12.

This ejection washer 11 is set, as shown in the drawings, between the insulating support 3 and the casing 4 of the socket.

The washer 11 can thus be pushed back by the front end of the casing 10 of the connector (FIGS. 3 and 4).

Besides, the washer 11 has at least one lip 13 (FIGS. 1 to 3) which at rest locks the safety disc 7 in a certain angular position by introducing itself into an appropriate slot of the latter.

It is to be understood that the safety disc 7 is unlocked by the displacement of the washer 11 under the action of the casing 10 of the connector 8 against the effect of the spring 12 as will be explained below, the safety disc 7 then being made to rotate by the contacts of the connector 8.

Figure 1:
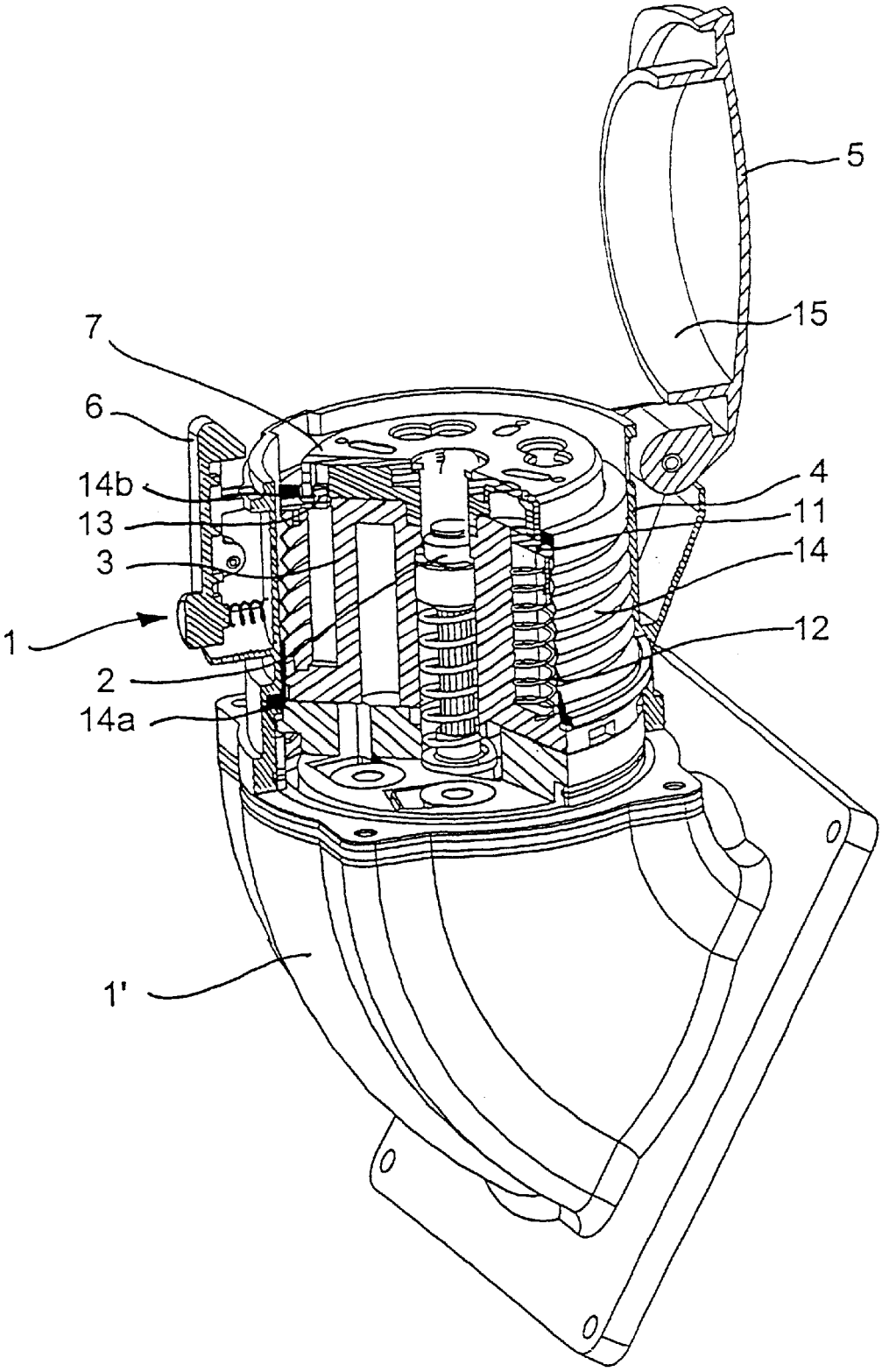
FIG. 1 shows an electric outlet socket according to the invention, in perspective and partial cross sections with its cover in the open position.

As the drawings show clearly, and in particular FIGS. 1 and 2, a bellows joint 14 is set around the insulating support 3 of the socket between the support 3 and the casing 4.

The base of the joint 14 presents an annular part 14*a*, set in this example as shown in the drawings, between the insulating support 3 and an appropriate groove of the casing 4, while the other end of the joint 14 presents a part 14*b* which covers at least part of the ejection washer 11.

The cover 5 also presents an annular skirt 15 whose height is chosen with certain precision to ensure that its front end exerts a certain pressure on part 14*b* of the joint 14 against the effect of the elastic Mechanism 12 of the ejection washer 11, as shown clearly in FIG. 2, thus ensuring a good seal.

Nonetheless, it can be well understood that in this position with the cover 5 closed, the latter must only push in the washer 11 gently and in any case not to the extent that its lip(s) 13 unlock the safety disc 7, which is clearly visible in FIG. 2.

If a good seal is ensured in the closed cover position, it is understood that a seal is also ensured in linkup position without connection according to FIG. 3, called the rest position, that is when the casing 10 of the connector 18, after being introduced into the casing 4 of the socket 1 with sufficient movement to exercise pressure on the washer 11 so as to unlock the safety disc 7 (the lip 13 withdrawing from its slot), has then driven the disc 7 in the usual manner into rotational movement by the usual way until the contacts of the connector 8 are aligned with those of the socket 1, the translation and rotation movements being obtained for example by way of a normal bayonet type system.

In this position in FIG. 3, the part 14*b* of the joint 14 is inserted under pressure between the front end of the casing 10 of the connector 8 and the ejection washer 11.

During the complementary translational shift which follows for the connector 8, with a view to carrying out the connection and locking of the connector 8 in the socket 1 by way of the hook 6 (FIG. 4), the joint 14 flattens completely or nearly, as shown in the FIG. 4, always ensuring a good seal.

It is understood that during unlinking, the joint 14 goes back to its initial position under the action of the spring 12 and the safety washer 7.

Nonetheless, it is also understood that spring 12 is used to advantage here, but one can evidently also envisage a specific elastic Mechanism for the joint 14.

Besides, according to the invention, a socket 1 could also be equipped without a safety disc 7, or on the contrary a socket with a safety disc and a supplementary disc, as envisaged in certain other known embodiments.

Finally, as mentioned above, the sleeve 1' of the socket 1 could be replaced by a handle, the ensemble constituting a prolongation, or again the handle 8' of the connector could be replaced by a sleeve and the sleeve 1' of the socket by a handle. Besides, in general, the sleeve 1' could also be an electric box provided with a connection cable inlet.

What is claimed is:

1. A first electrical connector comprising:

a casing;

an insulating support disposed within the casing;

a plurality of first electrical contacts mounted in the insulating support;

a bellows joint disposed between the insulating support and the casing; and at least one elastic mechanism adapted to bias the bellows joint towards an extended position, wherein the first electrical connector is adapted to connect to a second electrical connector having a plurality of second electrical contacts which engage the plurality of first electrical contacts, and wherein the bellows joint is adapted to move to a retracted position when the second electrical connector is connected to the first electrical connector.

2. The first connector of claim 1, further comprising a cover for protecting the first electrical connector.

3. The first connector of claim 1, wherein the first electrical connector is a socket connector and wherein the second electrical connector is a plug connector.

4. The first connector of claim 1, wherein the plurality of first electrical contacts of the first electrical connector are socket type contacts and wherein the plurality of second contacts of the second electrical connector are pin type contacts.

5. The first connector of claim 1, wherein the bellows joint is set in a sealed manner around the insulating support.

6. The first connector of claim 1, further comprising an ejection washer disposed between the insulating support and the casing.

7. The electrical connector of claim 1, further comprising an ejection washer and at least one safety disc.

8. The electrical connector of claim 7, wherein the at least one safety disc is adapted to be locked in an angular position.

9. The electrical connector of claim 7, wherein the safety disc comprises a lip for locking the safety disc in an angular position.

10. The electrical connector of claim 9, wherein the safety disc is disposed adjacent the ejection washer.

11. The electrical connector of claim 10, wherein the second electrical connector comprises a casing and wherein the casing of the second electrical connector is adapted to engage the ejection washer and move the bellows joint to the retracted position against a biasing force of the at least one elastic mechanism and wherein the safety disc is adapted to be unlocked when the casing of the second electrical connector engages the ejection washer.

12. An electrical connector including a first electrical connector adapted to be connected to a second electrical connector, said first electrical connector comprising:

a casing;

an insulating support disposed within the casing;

a plurality of first electrical contacts mounted in the insulating support;

a bellows joint disposed between the insulating support and the casing;

at least one elastic mechanism adapted to bias the bellows joint towards an extended position; and an ejection washer disposed between the insulating support and the casing, wherein the second electrical connector has a plurality of second electrical contacts which engage the plurality of first electrical contacts, and wherein the bellows joint is adapted to move to a retracted position when the second electrical connector is connected to the first electrical connector;

wherein the second electrical connector comprises a casing and wherein the casing of the second electrical connector is adapted to engage the ejection washer and move the bellows joint to the retracted position against a biasing force of the at least one elastic mechanism.

13. The electrical connector of claim 12, wherein the ejection washer comprises an upper surface which engages a shoulder of the bellows joint.

14. The electrical connector of claim 13, wherein the casing of the second electrical connector is adapted to move within the shoulder of the bellows joint.

15. The electrical connector of claim 13, wherein the ejection washer comprises a lower surface which engages the elastic mechanism.

16. The electrical connector of claim 12, further comprising a cover for protecting the first electrical connector, the cover including a skirt which is adapted to engage the ejection washer.

17. The electrical connector of claim 16, wherein the skirt comprises a length sufficient to move the bellows joint from the extended position when the cover is in a covering position.

18. The electrical connector of claim 12, wherein said at least one elastic mechanism serves to bias the bellows joint towards an extended position, the at least one elastic mechanism serving a double function, first, to bias the ejection washer, and second, to maintain the bellows in a stretched position.

19. An electrical connector comprising:

a cylindrical casing;

an insulating support disposed within the cylindrical casing;

a plurality of first electrical contacts mounted in the insulating support;

a bellows joint disposed between the insulating support and the cylindrical casing;

a movable biasing mechanism disposed between the insulating support and the cylindrical casing, the biasing mechanism having at least an extended position and a retracted position, wherein the electrical connector is adapted to connect to another connector having a plurality of second electrical contacts which engage the plurality of first electrical contacts.

20. An electrical connector comprising:

a cylindrical casing;

a cover pivotally mounted to the cylindrical casing;

a circular insulating support disposed within the cylindrical casing;

a plurality of first electrical contacts mounted in the insulating support;

a safety disc rotatably mounted to the insulating support;

a bellows joint disposed between the insulating support and the cylindrical casing;

an ejection washer engaging a movable biasing mechanism;

the movable biasing mechanism being disposed between the insulating support and the cylindrical casing;

the biasing mechanism having at least an extended position and a retracted position, wherein the electrical connector is adapted to connect to another connector having a plurality of second electrical contacts which engage the plurality of first electrical contacts.

21. An electrical connector including a first electrical connector adapted to connect to a second electrical connector, said first electrical connector comprising:

a casing;

an insulating support disposed within the casing;

a plurality of first electrical contacts mounted in the insulating support;

a bellows joint disposed between the insulating support and the casing; and at least one elastic mechanism adapted to bias the bellows joint towards an extended position, said second electrical connector having a plurality of second electrical contacts which engage the plurality of first electrical contacts, wherein the bellows joint is adapted to move to a retracted position when the second electrical connector is connected to the first electrical connector, wherein the second electrical connector comprises a casing and wherein the casing of the second electrical connector is adapted to move the bellows joint to the retracted position against a biasing force of the at least one elastic mechanism.

* * * * *